114-253 SR
3/8/88 XR 4,729,333

United States Patent [19]
Kirby et al.

[11] Patent Number: 4,729,333
[45] Date of Patent: Mar. 8, 1988

[54] REMOTELY-CONTROLLABLE PARAVANE

[75] Inventors: Robert A. Kirby, Houston, Tex.; Jorgen E. Petersen, Horsens, Denmark

[73] Assignee: Exxon Production Research Company, Houston, Tex.

[21] Appl. No.: 884,135

[22] Filed: Jul. 9, 1986

[51] Int. Cl.[4] ..... B63B 21/66
[52] U.S. Cl. ..... 114/244; 114/246; 114/253
[58] Field of Search ..... 367/16, 17, 18; 114/242, 244, 245, 246, 253

[56] References Cited

U.S. PATENT DOCUMENTS

| | | | |
|---|---|---|---|
| 2,589,312 | 3/1952 | Wilcoxon | 114/235 |
| 2,960,960 | 11/1960 | Fehlner | 114/235 |
| 2,981,220 | 4/1961 | Fehlner | 114/235 |
| 3,434,451 | 3/1969 | Brainard, II | 114/235 |
| 3,605,674 | 9/1971 | Weese | 114/235 B |
| 3,611,975 | 10/1971 | Ashbrook | 114/235 B |
| 3,613,629 | 10/1971 | Rhyne et al. | 114/235 B |
| 3,921,124 | 11/1975 | Payton | 340/7 R |
| 4,027,616 | 6/1977 | Guenther et al. | 114/244 |
| 4,033,278 | 7/1977 | Waters | 114/245 |
| 4,063,213 | 12/1977 | Itria et al. | 340/7 PC |
| 4,087,780 | 5/1978 | Itria et al. | 340/7 R |
| 4,130,078 | 12/1978 | Cholet | 114/244 |
| 4,193,366 | 3/1980 | Salminen | 114/274 |
| 4,323,989 | 4/1982 | Hackabee et al. | 367/17 |
| 4,350,111 | 9/1982 | Boyce, II | 114/245 |
| 4,463,701 | 8/1984 | Pickett et al. | 114/245 |
| 4,484,534 | 11/1984 | Thillaye du Boullay | 114/244 |
| 4,574,723 | 3/1986 | Chiles et al. | 114/253 |

FOREIGN PATENT DOCUMENTS

| | | |
|---|---|---|
| 2047406B | 9/1983 | United Kingdom . |
| 2122562A | 1/1984 | United Kingdom . |

*Primary Examiner*—Thomas H. Tarcza
*Assistant Examiner*—Ian J. Lobo
*Attorney, Agent, or Firm*—Keith A. Bell

[57] ABSTRACT

A remotely-controllable, surface-referenced paravane for use in towing an object in a body of water at a controlled lateral offset from the pathway of the towing vessel is disclosed. The principal components of the paravane are a buoyant hull, a cambered hydrofoil shaped keel attached to the bottom of the hull and extending generally downwardly into the body of water, a remotely-controllable steering means, and a tow cable which connects the paravane to the towing vessel. Passage of the cambered hydrofoil shaped keel through the water generates a lateral force, similar to the lift generated by an airfoil, which causes the paravane to move laterally away from the pathway of the towing vessel in the direction of the lateral force. The remotely-controllable steering means is used to compensate for changes in the speed of the towing vessel or variations in wind, waves, or currents so as to maintain the lateral offset of the paravane within certain limits. The paravane may be constructed so as to move laterally to the left (a "port" paravane) or to the right (a "starboard" paravane). The only difference between a port paravane and a starboard paravane is in the cross section of the cambered hydrofoil shaped keel, with one being the "mirror image" of the other.

10 Claims, 8 Drawing Figures

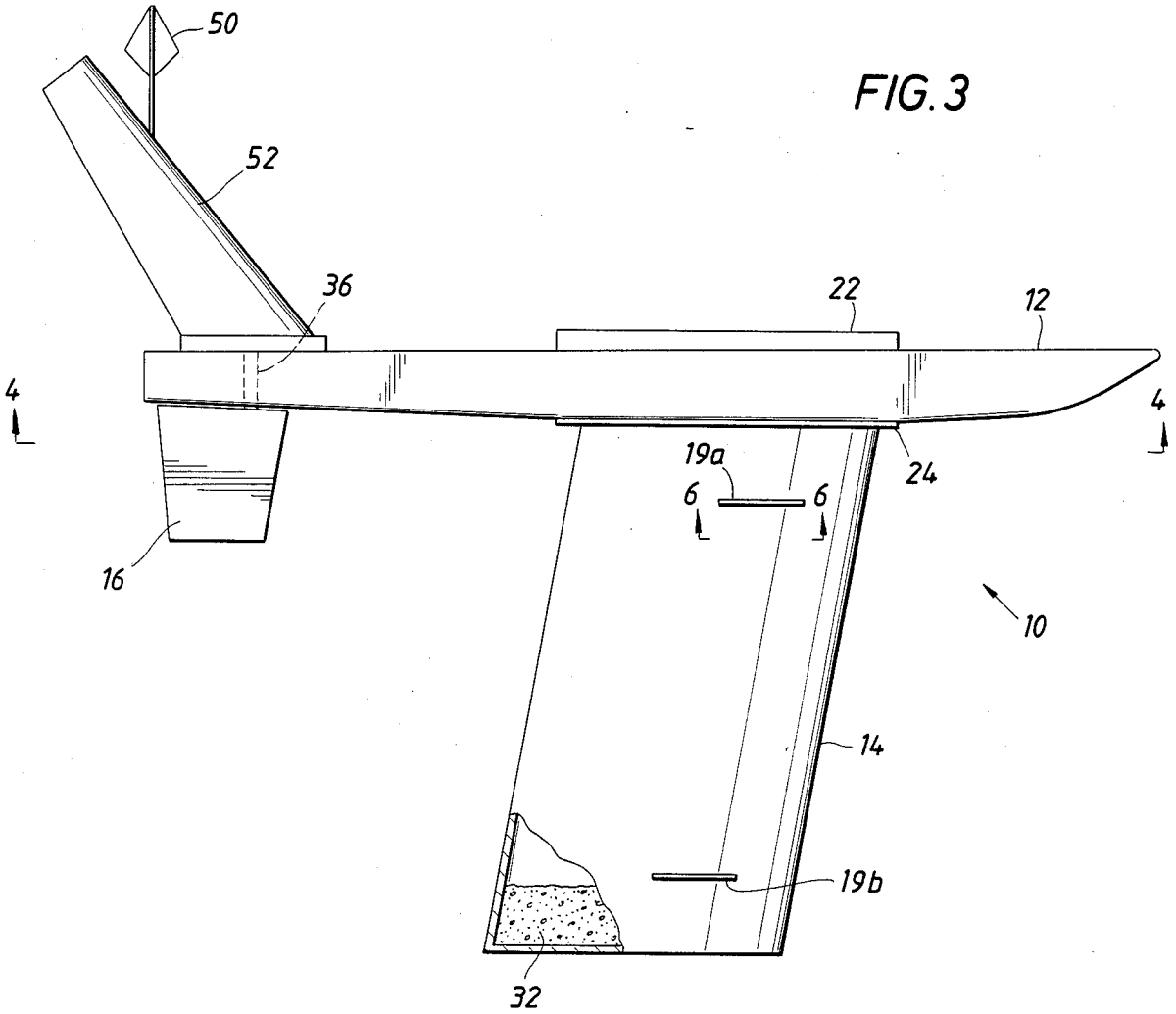
FIG. 3
FIG. 4
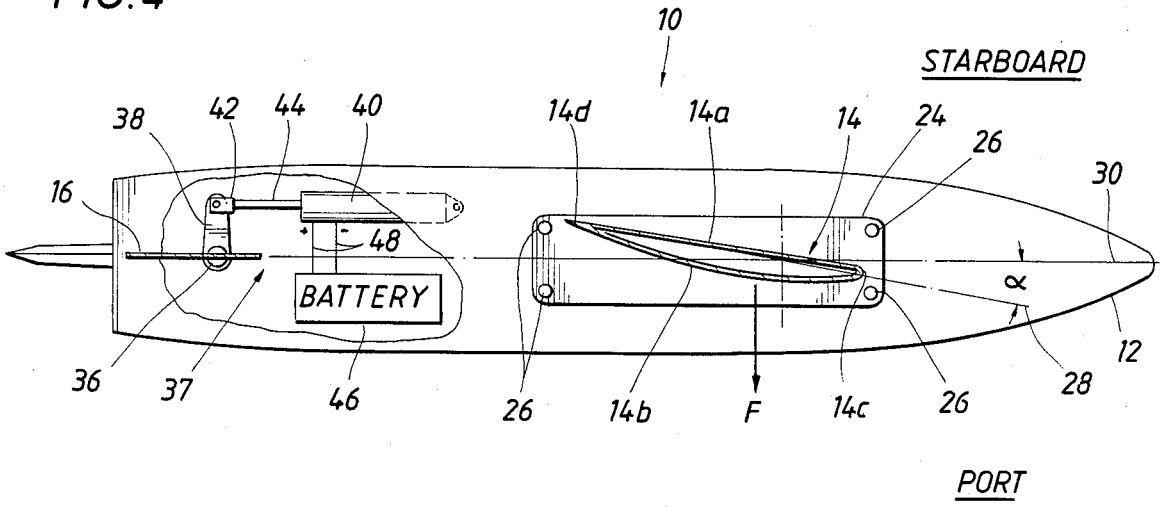

REMOTELY-CONTROLLABLE PARAVANE

FIELD OF THE INVENTION

The invention relates to the field of marine towing. More particularly, but not by way of limitation, the invention pertains to a remotely-controllable, surface-referenced paravane for use in towing an object at a controlled lateral offset from the pathway of the towing vessel. In the field of marine geophysical prospecting, the invention may be used to tow seismic sources and/or seismic receiver cables along discrete pathways parallel to but laterally spaced from the pathway of the towing vessel.

BACKGROUND OF THE INVENTION

In recent years the search for oil and gas has moved offshore. In order to locate potential offshore oil and gas reservoirs, it has been necessary to develop new devices and techniques for conducting marine geophysical prospecting operations. Due to the hostile environment in which they are conducted, such operations are typically quite difficult and costly to perform.

The primary method for conducting marine geophysical prospecting operations involves the use of towable marine seismic sources and seismic receiver cables. The basic principles of this prospecting method are well known to those skilled in the art. The seismic source(s) introduce seismic signals into the body of water. These signals propagate down through the water, across the water-floor interface, and into the subterranean geological formations, and are, to some extent, reflected by the interfaces between adjacent formations. The reflected signals travel upwardly through the geological formations and the body of water to a seismic receiver cable located near the surface of the body of water. The seismic receiver cable typically contains a number of hydrophones spaced along its length which record the reflected signals. Analysis of the signals recorded by the hydrophones can provide valuable information concerning the structure of the subterranean geological formations and possible oil and gas accumulation therein.

Early marine geophysical prospecting operations were generally conducted "in-line". In other words, the seismic source(s) and the seismic receiver cable were towed substantially directly behind the seismic vessel, and the resulting geophysical data was valid only for a relatively narrow band along the pathway of the vessel. Thus, the seismic vessel was required to make a number of passes along relatively closely spaced pathways in order to collect the necessary geophysical data for a given survey area. This requirement contributed directly to the cost and difficulty of conducting marine geophysical prospecting operations.

In order to reduce the number of passes of the seismic vessel necessary for any given survey area, and hence the cost of conducting the survey, the offshore geophysical industry has developed various devices and techniques for increasing the width of the "swath" of geophysical data collected during each pass of the seismic vessel. Generally such devices and techniques involve the use of multiple seismic sources and/or seismic receiver cables, each of which is towed by the seismic vessel along a discrete pathway which is parallel to but laterally spaced from the pathways of the other sources and receiver cables. Typically, the lateral spacing of the sources and receiver cables is symmetric about the pathway of the seismic vessel. See, for example, the wide seismic source disclosed in U.S. Pat. No. 4,323,989 issued Apr. 6, 1982 to Huckabee et al.

In addition to reducing the number of passes necessary for a particular survey area, the use of multiple seismic sources and/or seismic receiver cables may improve the quality of the resulting geophysical data. For example, the use of an array of seismic sources can increase the signal to noise ratio of the signal recorded by the hydrophones, thereby resulting in higher quality geophysical data. Further, the use of a plurality of seismic sources which are activated or fired simultaneously can increase the amount of energy in the seismic pulse, thereby permitting data to be gathered from very deep subterranean formations.

In order for a single vessel to tow multiple seismic sources and/or seismic receiver cables along laterally spaced parallel pathways, means must be provided for causing the objects being towed to move laterally away from the pathway of the towing vessel. One such means is disclosed in U.S. Pat. No. 4,130,078 issued Dec. 19, 1978 to Cholet. Cholet discloses a device comprising at least two parallel deflectors secured to a floating member. Each of the deflectors consists of a series of parallel paddles which are oriented obliquely to the trajectory of the device so that hydrodynamic pressure on the paddles forces the device in a lateral direction. The paddles may be either curved or flat sheets. The amount of lateral offset produced by this device is dependent on the speed that it is towed through the water, and the device cannot be remotely controlled.

Another device for laterally shifting the trajectory of a towed object is disclosed in U.S. Pat. No. 3,613,629 issued Oct. 19, 1971 to Rhyne et al. The Rhyne et al. device consists of a streamlined float with a diverter arrangement rigidly suspended below the float. Hydrodynamic pressure on the diverter causes the device to move laterally away from the pathway of the towing vessel. As with the Cholet device, the amount of lateral offset produced by the Rhyne et al. device is dependent on its speed through the water, and it cannot be remotely controlled.

Still another device for laterally shifting the trajectory of a towed object is disclosed in the above referenced patent to Huckabee et al. That device comprises an elongated float equipped with a remotely-adjustable rudder. The only lateral force generated by the Huckabee et al. device is the force resulting from hydrodynamic pressure on the rudder. Accordingly, the device is not capable of achieving large lateral offsets. Outriggers on the vessel are used to increase the maximum lateral offset produced by the device.

Submerged paravanes have been used heretofore in marine operations for a variety of purposes. For example, in commercial fishing operations submerged paravanes have been used to hold open a fishing net being towed by a vessel. Submerged paravanes have also been used in minesweeping operations to laterally shift the trajectory of the minesweeping equipment away from the pathway of the towing vessel. An example of one such submerged paravane is disclosed in U.S. Pat. No. 2,960,960 issued Nov. 22, 1960 to Fehlner. The Fehlner paravane consists of a cambered hydrofoil shaped paravane wing containing a depth control mechanism. As the paravane wing is towed through the water, the cambered hydrofoil shape generates a substantially lateral hydrodynamic force similar to the "lift" generated by an airfoil. This lateral hydrodynamic force causes the paravane wing to move laterally away from the pathway of the towing vessel. As with the surface-referenced devices described above, the amount of lateral movement is dependent on the speed of the towing vessel, and the paravane wing cannot be remotely controlled. Further, unless the paravane wing is maintained in a substantially vertical orientation, the lateral hydrodynamic force will have a vertical component which will cause the depth of the paravane wing to fluctuate.

As described above, the use of multiple seismic sources and/or multiple seismic receiver cables towed along discrete pathways parallel to but laterally spaced from the pathway of the seismic vessel may be highly beneficial in conducting marine geophysical prospecting operations, both from the standpoint of reducing the cost of conducting the survey and from the standpoint of improving the quality of the resulting geophysical data. However, the accuracy and reliability of the resulting geophysical data is dependent on precisely maintaining the lateral spacing of the various components of the system throughout the time during which the seismic vessel is traversing the survey area. Thus, the benefits resulting from the use of multiple sources and/or multiple receiver cables may be lost if the towing system is not capable of being remotely controlled and adjusted to compensate for changes in the speed of the towing vessel or variations in wind, waves, or currents. Accordingly, the need exists for a remotely-controllable device capable of maintaining the lateral offset of a towed object within certain limits over a broad range of operating conditions.

SUMMARY OF THE INVENTION

The present invention is a remotely-controllable, surface-referenced paravane for use in towing an object along a pathway parallel to but laterally spaced from the pathway of the towing vessel. As used herein, "surface-referenced" means that the paravane is buoyant and that it remains substantially on the surface of the body of water during operation. The inventive paravane satisfies the need described above for a device capable of maintaining the lateral offset of a towed object within certain limits over a broad range of operating conditions. Further, due to its unique design, the paravane is capable of attaining and maintaining larger lateral offsets than have heretofore been possible using conventional surface-referenced devices.

The principal components of the inventive paravane are a buoyant hull, a cambered hydrofoil shaped keel which is attached to the bottom of the hull and extends generally downwardly into the body of water, a remotely-controllable steering means, and a tow cable which connects the paravane to the towing vessel. Passage of the cambered hydrofoil shaped keel through the water generates a lateral hydrodynamic force similar to the lift generated by an airfoil. This lateral hydrodynamic force causes the paravane to move laterally away from the pathway of the towing vessel in the direction of the lateral force.

For marine geophysical prospecting operations, both port and starboard (left and right) paravanes would typically be used to provide a symmetrical pattern of sources and receiver cables. As more fully described below, the only difference between a port paravane and a starboard paravane is in the cross sectional shape of the keel, with one being the "mirror image" of the other.

The amount of lateral force generated by the cambered hydrofoil shaped keel may be increased by attaching the keel to the buoyant hull so that the chord line of the cambered hydrofoil shaped cross section forms a positive angle of attack with the longitudinal centerline of the hull. This will cause a hydrodynamic pressure force on the pressure side of the keel as it passes through the water which will be in substantially the same direction as, and will be supplementary to, the lateral hydrodynamic force generated by the cambered hydrofoil shaped keel. Additionally, as more fully described below, the effective angle of attack may be varied by changing the point(s) at which the tow cable is attached to the keel.

The remotely-controllable steering means typically would comprise a conventional rudder, the angular position of which may be controlled and adjusted from a remote location such as the towing vessel. Alternatively, other steering means, such as the powered propeller nozzle described below, may be used if desired. Preferably, the steering means would be controlled and adjusted by a rudder control means located on board the paravane. A radio wave link having a transmitter located on board the towing vessel and a receiver/controller tuned to the same frequency channel as the transmitter located on board the paravane typically would be used to remotely activate and control the rudder control means. Any suitable rudder control means may be used.

The paravane of the present invention may include additional peripheral equipment such as rudder position sensors, range and azimuth measuring instrumentation, and additional radio wave links for communicating between the seismic vessel and the paravane. Data from these sensors and instruments may be continuously fed into a computer located on board the seismic vessel which would continuously monitor the precise location of the paravane and initiate any necessary corrective actions to precisely maintain the lateral offset of the paravane.

BRIEF DESCRIPTION OF THE DRAWINGS

The actual operation and advantages of the present invention will be better understood by referring to the following detailed description and the attached drawings in which:

FIG. 3 is a side elevational view of the embodiment of the paravane illustrated in FIG. 1;

FIG. 4 is a bottom plan view, in partial section, of the paravane taken along line 4—4 of FIG. 3 and showing the cambered hydrofoil shaped cross section of a "port" paravane keel;

While the invention will be described in connection with the preferred embodiments, it will be understood that the invention is not limited thereto. On the contrary, it is intended to cover all alternatives, modifications, and equivalents which may be included within the spirit and scope of the invention.

DETAILED DESCRIPTION OF THE PREFERRED EMBODIMENTS

Figure 1:
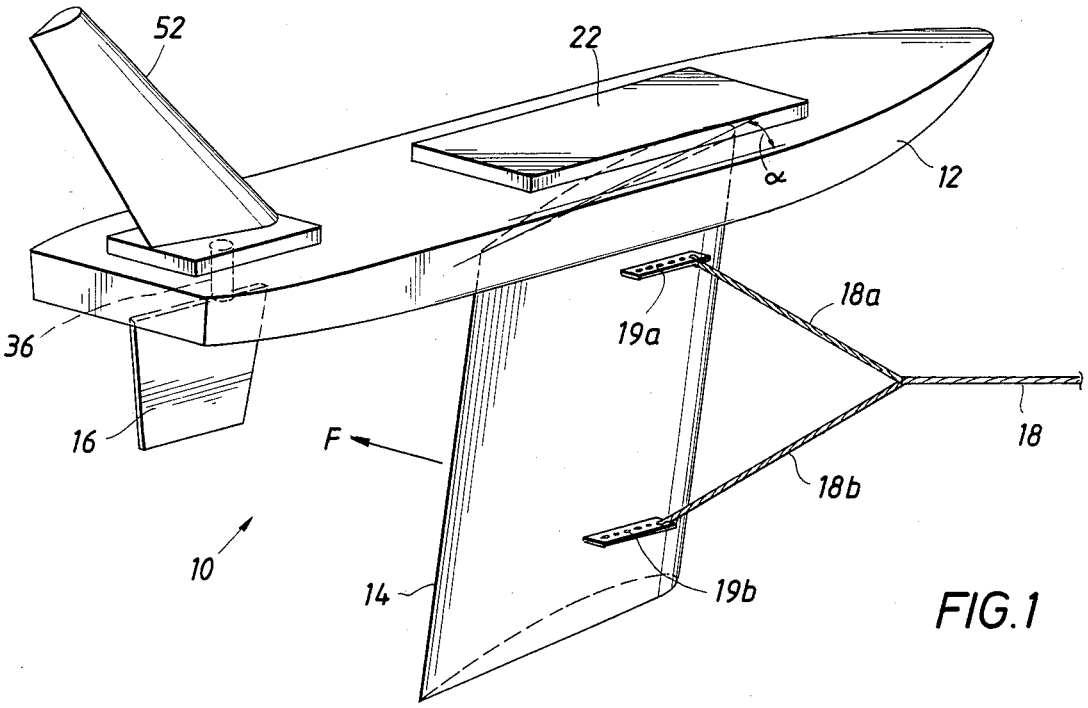
FIG. 1 is a perspective view illustrating the principal components of a first embodiment of the paravane of the present invention.
Figure 2:
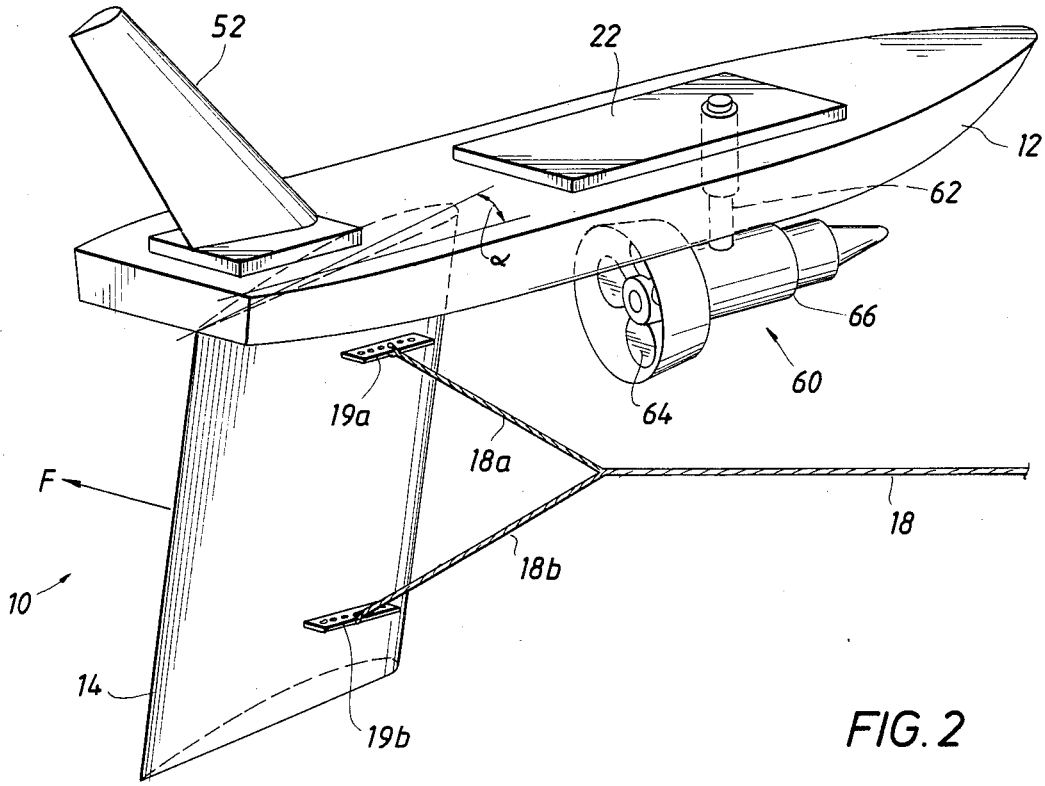
FIG. 2 is a perspective view illustrating the principal components of a second embodiment of the paravane.

The two primary embodiments of the paravane are illustrated, respectively, in FIGS. 1 and 2. FIG. 1 illustrates the "yacht" embodiment of the paravane; FIG. 2 illustrates the "canard" embodiment. As more fully described below, the principal difference between the yacht and canard embodiments of the paravane is in the placement of the steering means with respect to the keel. In the yacht embodiment (FIG. 1) the steering means (rudder 16) is located behind the keel. In the canard embodiment (FIG. 2) the steering means (propeller nozzle 60) is located in front of the keel.

Figures 5, 7:
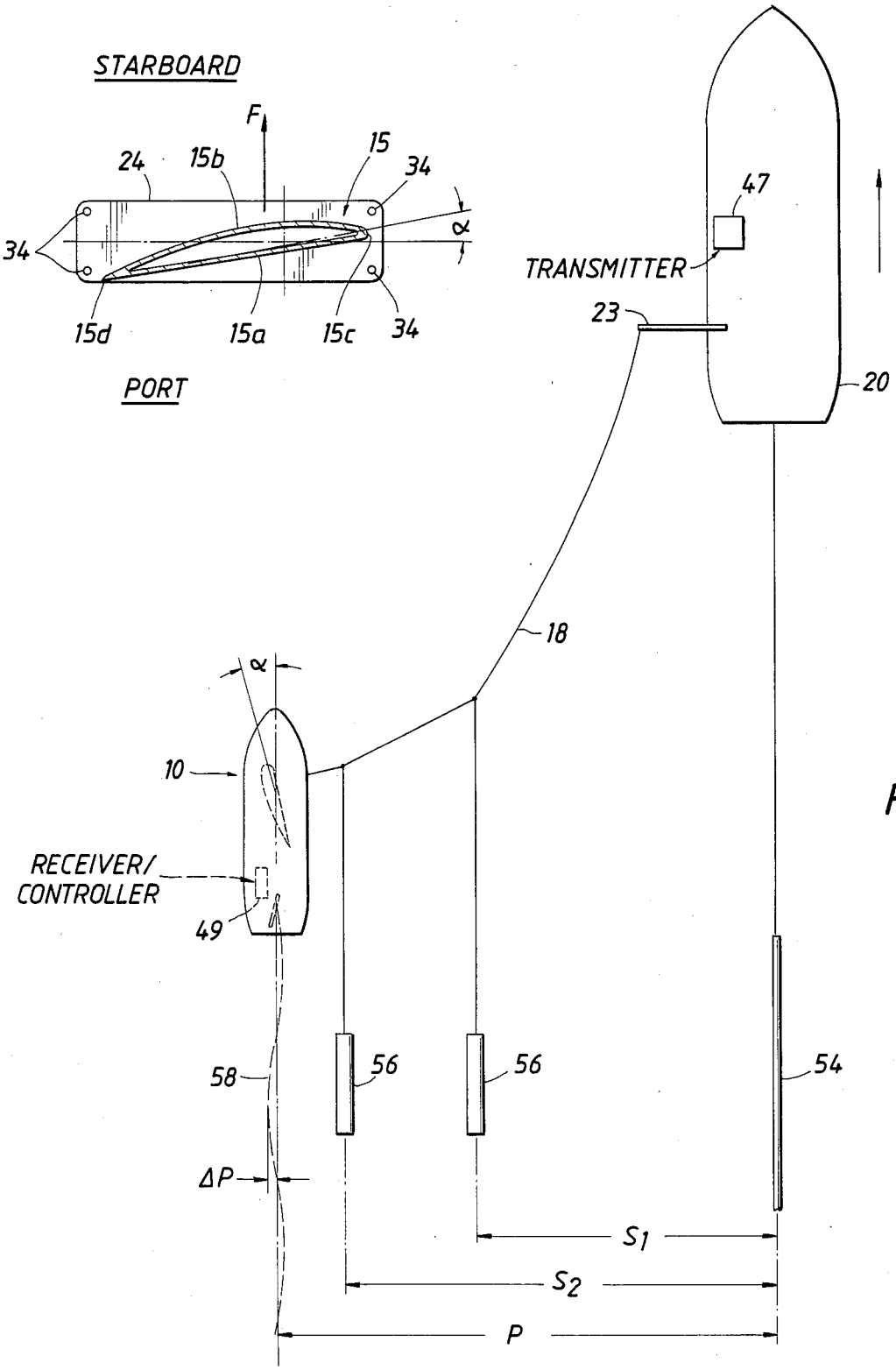
FIG. 5 is a bottom plan view, in partial section, showing the cambered hydrofoil shaped cross section of a "starboard" paravane keel.
FIG. 7 is a partial schematic plan view showing the paravane of the present invention being used to tow multiple seismic sources.
Figure 8:
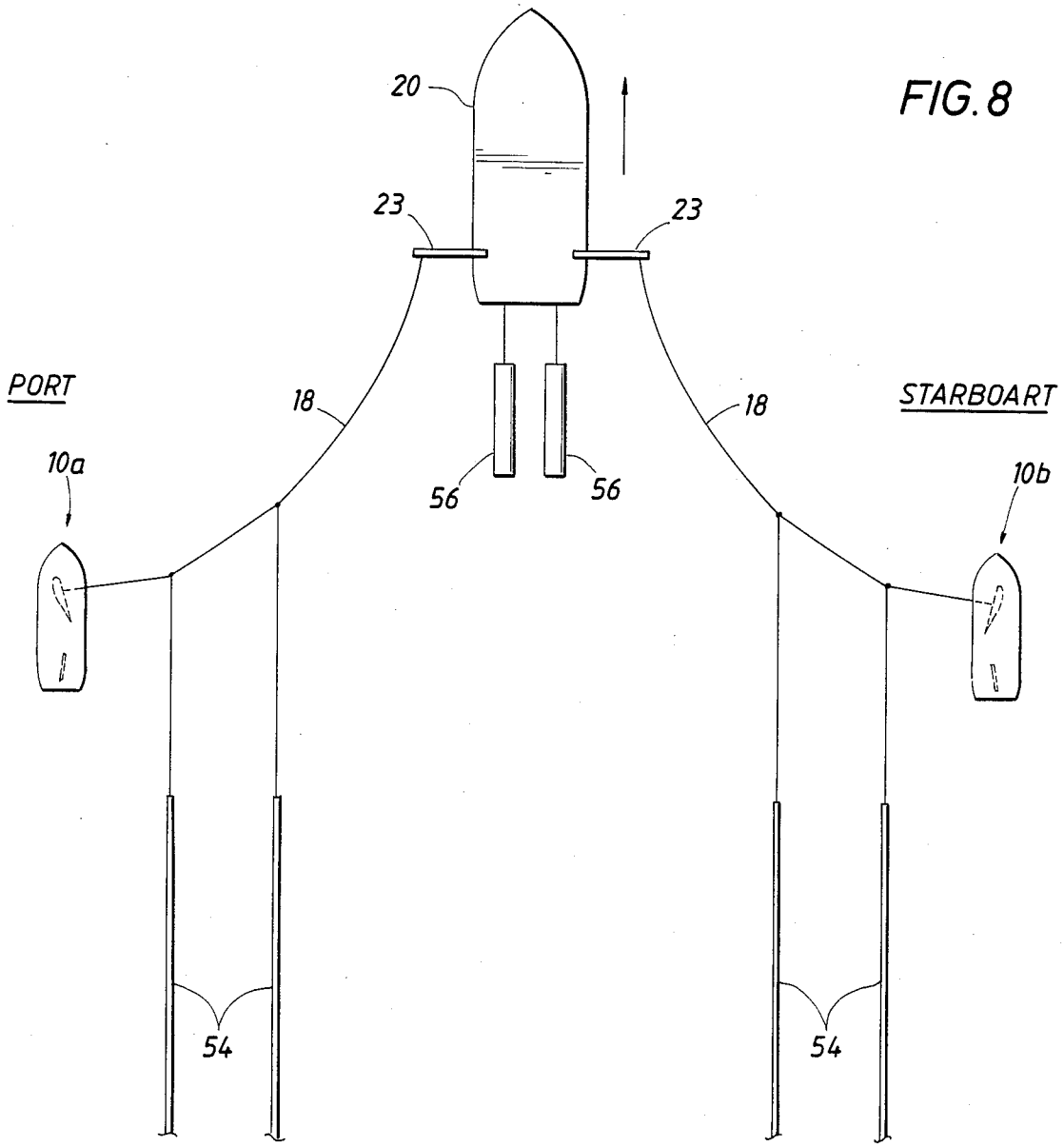
FIG. 8 is a schematic plan view showing the paravane being used to tow multiple seismic receiver cables.

In the embodiment illustrated in FIGS. 1, 3, and 4, the primary components of the paravane, generally indicated at 10, are buoyant hull 12, keel 14, rudder 16, and tow cable 18 (FIG. 1 only) which connects the paravane 10 to the towing vessel 20 (see FIGS. 7 and 8). Additionally, as more fully described below, paravane 10 also includes a rudder control means for controlling and adjusting the angular position of rudder 16 about a substantially vertical axis.

Buoyant hull 12 provides all of the buoyancy necessary for paravane 10 to float on the surface of the body of water. Preferably, buoyant hull 12 is of hollow construction so that the rudder control means and other peripheral equipment can be housed therein. Part or all of the hull 12 may be filled with a closed cell foam as a protection against leaking. Hull 12 would typically be made of a suitable light-weight material such as fiberglass or aluminum. A removable, water-tight hatch 22 may be used to provide access to the interior of hull 12, as is well known in the art. Buoyant hull 12 should be configured so as to substantially minimize the towing resistance of paravane 10 while maintaining adequate hydrodynamic stability. As illustrated herein, hull 12 is configured similarly to a conventional surfboard; however other shapes may be used if desired.

The primary purpose of keel 14 is to generate the lateral force necessary to move paravane 10 laterally away from the pathway of the towing vessel. As more clearly shown in FIGS. 3 and 4, keel 14 is a cambered hydrofoil which is attached to the bottom of buoyant hull 12 and extends generally downwardly into the body of water. As the paravane 10 is towed through the surrounding water, keel 14 generates a lateral hydrodynamic force F in the same manner as an airfoil generates lift. It will be understood that the lateral hydrodynamic force generated by keel 14 is actually a small force per unit area distributed over the entire surface area of keel 14, and that force F, as illustrated in the drawings, is the resultant obtained by adding together all of these smaller forces. For a keel having a uniform cross sectional area from top to bottom, force F will be located at the midpoint of the keel's vertical span.

Keel 14 is rigidly attached to flange plate 24 which is removably attached to buoyant hull 12 by bolts 26 or the like. Ballast 32 (see FIG. 3), which may be sand, concrete, steel, lead, or the like, may be placed in the bottom of keel 14 to increase the hydrodynamic stability of paravane 10. The remainder of keel 14 may be foam filled as a protection against leaking. As with hull 12, keel 14 would typically be made of a light-weight material such as fiberglass or aluminum.

As illustrated in FIGS. 1, 2, and 3, keel 14 is shown as having a backward slant from top to bottom. This backward slant is known as the "rake aft" of the keel 14. Although not necessary for the invention, a certain amount of rake aft tends to improve the hydrodynamic handling characteristics of the paravane 10. As illustrated, the rake aft of keel 14 is approximately 10° from the vertical; however, as much as 45° or more of rake aft may be used if desired.

Preferably, keel 14 should be configured and mounted so as to substantially maximize the lateral hydrodynamic force F generated by the passage of the keel through the surrounding water. As illustrated in FIG. 4, the cambered hydrofoil shaped cross section of keel 14 has an almost flat pressure side **14*a* and a highly cambered reduced-pressure side 14*b*; however, other cambered hydrofoil shapes may be used if desired. Typically, keel 14 would be attached to flange plate 24 so that the chord line 28 of its cross section forms a positive angle of attack "$\alpha$" with the longitudinal centerline 30 of buoyant hull 12. (As used herein and in the claims, "chord line" means a straight line connecting the leading edge 14*c* and the trailing edge 14*d* of the hydrofoil cross section and a "positive angel of attack" means that the leading edge 14*c* of the hydrofoil has been rotated away from the longitudinal centerline 30 of buoyant hull 12 in the direction of lateral force F, as illustrated in FIG. 4**). The angle of attack $\alpha$ may be as small as one or two degrees or as large as ten to fifteen degrees; however, beyond a certain angle (the "critical" angle) the hydrodynamic flow characteristics of the keel are lost, similarly to the stalling angle of an airfoil.

Towing cable 18 connects the paravane 10 to the towing vessel 20 (see FIGS. 7 and 8). Typically, cable 18 would be connected to the keel 14 of paravane 10; however, alternatively it may be attached to hull 12 if desired. As illustrated in FIGS. 1 and 2, cable 18 is split into two separate strands **18*a* and 18*b* near keel 14. Strand 18*a* is attached to tow point adjustment block 19*a* located near the top of keel 14 while strand 18*b* is attached to tow point adjustment block 19*b* located near the bottom of keel 14. Since the resultant lateral force F generated by keel 14 is directed away from cable 18 and is located between the two tow point adjustment blocks, this double attachment helps to maintain the paravane 10** in an upright position during towing.

Figure 6:
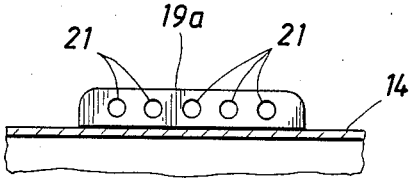
FIG. 6 is a bottom plan view taken along line 6—6 of FIG. 3 showing one embodiment of the tow point adjustment block.

As most clearly shown in FIG. 6, each of the tow point adjustment blocks **19*a* and 19*b* has a series of holes 21 therethrough. Cable strands 18*a* and 18*b* can be attached, respectively, to tow point adjustment blocks 19*a* and 19*b* at any of these holes. It has been found that the amount of lateral force generated by keel 14 increases as the connection point moves toward the rear of keel 14. This increase in lateral force results from the fact that as the connection point moves backward, the entire paravane 10** tends to skew or "crab" sideways slightly thereby increasing the effective angle of attack.

As illustrated in FIGS. 1 through 4, paravane 10 is a left or "port" paravane. In other words, as it is towed through the water, paravane 10 will move laterally to the left away from the pathway of the towing vessel. For geophysical prospecting operations, a right or "starboard" paravane will typically also be necessary in order to provide a symmetric array of sources and/or receiver cables. As will be obvious to those skilled in the art, the cross section of the keel of a starboard paravane will typically be the "mirror image" of the cross section of a port paravane keel. FIG. 5 illustrates a bottom plan view of the keel 15 of a starboard paravane. The pressure side 15*a*, reduced-pressure side 15*b*, and angle of attack $\alpha$ are the mirror images of those shown in FIG. 4 for a port paravane keel. Accordingly, the lateral force F generated by keel 15 will also be in the opposite direction. Preferably, flange plate 24 and the mounting holes 34 therein are identical for both port and starboard keels so that either type of keel may be attached to a given hull 12.

Referring again to FIGS. 1, 3 and 4, the lateral offset of paravane 10 as it is being towed through the water may be remotely controlled and adjusted through rudder 16. Typically, rudder 16 would be a substantially vertical plate attached to a shaft 36 which extends upwardly into the interior of buoyant hull 12 through a suitable water-tight bearing or bushing (not shown).

As noted above, a rudder control means is used for controlling and adjusting the angular position of rudder 16 about a substantially vertical axis (i.e., shaft 36). One suitable rudder control means, generally indicated at 37, is illustrated in FIG. 4. A crank arm 38 is fixedly attached at one of its ends to shaft 36. The other end of crank arm 38 is pivotally attached to electric push-pull actuator 40 by clevis 42 and rod 44. Electrical power to operate actuator 40 is provided by battery 46 through electrical wires 48. By extending or retracting rod 44, actuator 40 is capable of adjusting the angular position of rudder 16 up to about $\pm 45°$ from its neutral position (as illustrated). Other suitable rudder control means will be obvious to those skilled in the art.

The rudder control means must be capable of being activated and controlled from a remote location such as the towing vessel. This might be accomplished through an electrical umbilical stretching from the vessel to the paravane. Preferably, however, the rudder control means would be activated by a radio wave link. A radio wave transmitter 47 (see FIG. 7) is located on board the vessel 20 and a receiver/controller 49 (tuned to the same frequency channel as the transmitter) is located in the interior of hull 12 of paravane 10. Typically, an antenna 50 (see FIG. 3) for receiver/controller 49 would be located in the mast 52 mounted on the rear of hull 12. Mast 52 may also contain other peripheral equipment such as transmitter or receiver antennas for rudder position sensors or range and azimuth measuring instrumentation. As is well known in the art, transmitter 47 and receiver/controller 49 may be used to remotely activate and control the movement of actuator 40 and thereby the angular position of rudder 16.

Operation of paravane 10 is illustrated in FIG. 7. The towing vessel 20 is proceeding in the direction of the arrow and is towing one in-line seismic receiver cable 54 together with port paravane 10. Two seismic sources 56 are attached to the cable 18 between vessel 20 and port paravane 10. Cable 18 may be attached directly to vessel 20 or, optionally, to an outrigger 23 so as to increase the maximum lateral offset of paravane 10. Typically, a starboard paravane (not shown) and two additional seismic sources 56 would be used to provide symmetry about the pathway of vessel 20. It will be understood that additional sources and receiver cables could also be used if desired.

It is desired to maintain the lateral offsets $S_1$ and $S_2$ between the pathway of the vessel 20 and the two seismic sources 56 as precisely as possible during the time the seismic vessel is traversing the survey area. In order to do so, remotely controllable paravane 10 must be maintained as nearly as possible at a lateral offset of P. This is accomplished by continually monitoring the position of paravane 10 with respect to vessel 20 and remotely adjusting the angular position of rudder 16 so as to compensate for any changes resulting from variations in wind, waves, currents, or the speed of vessel 20.

The actual course of paravane 10 will likely vary within certain limits as indicated by the dashed line 58 in FIG. 7. The amount of variation, $\Delta P$, will be dependent on the sensitivity of the system used to detect and compensate for position changes of paravane 10. For example, if detection of position changes is done visually, $\Delta P$ may be substantial. On the other hand, $\Delta P$ can be substantially minimized through the use of electronic range and azimuth measuring instrumentation together with an automatic computer (not shown) located on board vessel 20. Output from the range and azimuth measuring instrumentation would be continuously monitored by the computer which would issue appropriate instructions through the radio wave link to correct for any changes in the position of paravane 10. A rudder position sensor (not shown) on board paravane 10 might also be used to continuously monitor the position of rudder 16 and to indicate when the rudder has reached its maximum movement.

FIG. 8 illustrates schematically the use of the present invention to tow multiple seismic receiver cables. Vessel 20 is proceeding in the direction of the arrow and is towing one or more seismic sources 56 (two shown) substantially directly behind the vessel. Port paravane 10*a* and starboard paravane 10*b* are each connected to vessel 20 by a cable 18 in the manner previously described. One or more seismic receiver cables 54 are attached to each of the cables 18. Each of the paravanes is remotely controlled by a separate, discrete radio channel so as to maintain the lateral spacing of the seismic receiver cables 54 as precisely as possible during the time vessel 20 is traversing the survey area.

As noted above, the canard embodiment of the paravane is illustrated in FIG. 2. In the canard embodiment, the keel 14 is located behind the steering means which, as illustrated, is powered propeller nozzle 60.

Propeller nozzle 60 is attached to a substantially vertical shaft 62 which extends upwardly into hull 12 through a suitable water-tight bearing or bushing (not shown). The angular position of propeller nozzle 60 is remotely-controllable in the same manner as described above for rudder 16. Additionally, propeller nozzle 60 contains a propeller 64 which typically would be powered by an electric motor (not shown) located in the forward housing 66 of propeller nozzle 60. One or more batteries located in the interior of hull 12 (not shown) or an electrical umbilical (not shown) would be used to power the motor. Alternatively, a hydraulic drive system could be used to power the propeller 64. Accordingly, in addition to providing an acceptable steering means, propeller nozzle 60 also may be used to independently drive paravane 10. This may increase the maximum lateral offset which can be achieved by the paravane.

The paravane of the present invention may be of any suitable size. However, for marine geophysical prospecting operations, the length of buoyant hull 12 would generally be between about ten and about 25 feet. Similarly, the width of the hull would generally be from about two to about four feet and the depth of the keel would generally be from about five to about ten feet.

The present invention and the best modes contemplated for practicing the invention have been described. It should be understood that the invention is not to be unduly limited to the foregoing which has been set forth for illustrative purposes. Various modifications and alternatives of the invention will be apparent to those skilled in the art without departing from the true scope of the invention. For example, the two different steering means illustrated in FIGS. 1 and 2 (rudder 16 and propeller nozzle 60) could be interchanged with the rudder 16 being used on the canard embodiment of the invention and the propeller nozzle 60 being used on the yacht embodiment. Accordingly, the invention is to be limited only by the scope of the appended claims.

We claim:

1. A remotely-controllable paravane for use in towing an object in a body of water along a discrete pathway parallel to but laterally spaced from the pathway of the towing vessel, said paravane comprising:

a buoyant hull having a longitudinal centerline;

a keel attached to said buoyant hull and extending generally downwardly into said body of water, said keel having a pressure side, a reduced-pressure side, and a cambered hydrofoil shaped cross section, said cross section having a chord line, said keel being attached to said buoyant hull so that said chord line forms a positive angle of attack with said longitudinal centerline of said buoyant hull, whereby passage of said keel through said body of water generates a substantially lateral hydrodynamic force on said keel to move said paravane laterally away from said pathway of said towing vessel;

remotely-controllable steering means attached to said buoyant hull, said steering means adapted to be remotely controlled from said towing vessel to control the course of said paravane; and a tow cable having a first end attached to said towing vessel and a second end attached to said paravane.

2. The remotely-controllable, paravane of claim 1, wherein said keel is located in front of said remotely-controllable steering means.

3. The remotely-controllable, paravane of claim 1 wherein said keel is located behind said remotely-controllable steering means.

4. The remotely-controllable, paravane of claim 1 wherein said remotely-controllable steering means comprises:

a substantially vertical rudder; and a rudder control means adapted to control and adjust the angular position of said rudder about a substantially vertical axis.

5. The remotely-controllable, paravane of claim 1 wherein said remotely-controllable steering means comprises:

a powered propeller nozzle suspended beneath said hull and oriented so as to provide a substantially horizontal thrust; and a control means adapted to control and adjust the angular position of said powered propeller nozzle about a substantially vertical axis.

6. The remotely-controllable, paravane of claim 1 wherein said cambered hydrofoil shaped cross section of said keel is configured so that said substantially lateral hydrodynamic force is directed toward the port side of said paravane.

7. The remotely-controllable, paravane of claim 1 wherein said cambered hydrofoil shaped cross section of said keel is configured so that said substantially lateral hydrodynamic force is directed toward the starboard side of said paravane.

8. The remotely-controllable paravane of claim 1 wherein said tow cable is divided into first and second strands near said paravane, and wherein said first and second strands are attached to said paravane, respectively, at first and second vertically spaced apart points on said pressure side of said keel to assist in maintaining said paravane in a substantially upright position during tow.

9. The remotely-controllable paravane of claim 8, said paravane further comprising upper and lower tow cable attachment blocks attached to said pressure side of said keel, respectively, at said first and second vertically spaced apart points, and wherein said first and second strands of said tow cable are attached, respectively, to said upper and lower tow cable attachment blocks.

10. The remotely-controllable paravane of claim 9 wherein said upper and lower tow cable attachment blocks each has a plurality of longitudinally spaced attachment locations thereon, said first and second strands being adapted to be attached to said upper and lower tow cable attachment blocks at any of said longitudinally spaced attachment locations so as to vary the effective angle of attack of said keel during tow.

* * * * *